United States Patent [19]

Shepard

[11] Patent Number: 4,988,108

[45] Date of Patent: Jan. 29, 1991

[54] QUESTION AND ANSWER GEOGRAPHY BOARD GAME

[76] Inventor: Howard F. Shepard, 16707 Quai Park Dr., Missouri City, Tex. 77489

[21] Appl. No.: 385,393

[22] Filed: Jul. 24, 1989

[51] Int. Cl.[5] ..... A63F 3/04; A63F 9/18

[52] U.S. Cl. ..... 273/254; 273/243

[58] Field of Search ..... 273/249, 250–254, 273/296, 308, 256, 257, 243

[56] References Cited

U.S. PATENT DOCUMENTS

| | | | |
|---|---|---|---|
| 387,220 | 8/1888 | Forker | 273/296 |
| 613,435 | 11/1898 | Wright | 273/252 |
| 1,745,946 | 2/1930 | Murray | 273/296 |
| 3,368,816 | 2/1968 | Milazzo et al. | 273/257 |
| 4,211,419 | 7/1980 | Larsen | 273/248 |
| 4,557,485 | 12/1985 | Lardon | 273/249 |
| 4,834,389 | 5/1989 | Coffman et al. | 273/252 |

FOREIGN PATENT DOCUMENTS

| | | | |
|---|---|---|---|
| 184517 | 8/1922 | United Kingdom | 273/251 |

*Primary Examiner*—Benjamin Layno

*Attorney, Agent, or Firm*—Pravel, Gambrell, Hewitt, Kimball & Krieger

[57] ABSTRACT

A board game apparatus designed to guide and educate the players about geography in a particular region, on a particular continent, or of the world itself. The apparatus includes a board comprising at least one map bearing the geographical indicia characterizing separate locations to be depicted and identified. The separate locations are each distinguishable by a color and a number. A trail forms a closed loop around the map. The trail is divided into a plurality of spaces. Each space is also distinguishably colored and numbered to correspond to a separate location on the map. There is a plurality of playing cards one for each separate location containing identifying information about these locations to include the location's name, and the name of that location's capital city on one side, and a colored and numbered map of the location on the other side of that card. Players move their tokens along the trail according to a spinner. Upon landing on a colored and numbered space, each player is authorized to name the corresponding location, it's capital, and answer questions supplied through random selection of a card bearing a question on one side, and an answer to that question on the other side of that card. A third set of cards is to be awarded to players upon their proper identification of a capital city.

The winner is the person who has collected the greatest number of points through identification of locations, their capitals, and responding correctly to the question cards.

2 Claims, 5 Drawing Sheets

QUESTION AND ANSWER GEOGRAPHY BOARD GAME

BRIEF SUMMARY OF THE INVENTION

The main objective of the invention is to provide a game apparatus which provides the players with the opportunity to develop geographic recognition skills through a sequence of turns that will allow the players to attempt to name states in the U.S.A. or countries elsewhere in the world and the capitals of each, as well as answer questions associated with the geographic regions they are attempting to identify. The game apparatus includes a board that has an attached free moving pointer designed to determine the number of spaces moved by each token, a plurality of game cards, and moveable tokens for travel around the board. The winner is determined through an accumulation of points earned by correctly naming these locations and answering those questions associated with the games.

DESCRIPTION OF DRAWINGS

FIG. 2' is a bottom view of one of the tokens as shown in FIG. 2.

FIG. 2" is a top view of one of the tokens as shown in FIG. 2.

FIG. 3A' is a back view of a capital card.

FIG. 3B' is a back view of a game card.

FIG. 3C is a front view of a geoquestion card.

FIG. 3C' is a back view of a geoquestion card.

DETAILED DESCRIPTION

Figure 1:
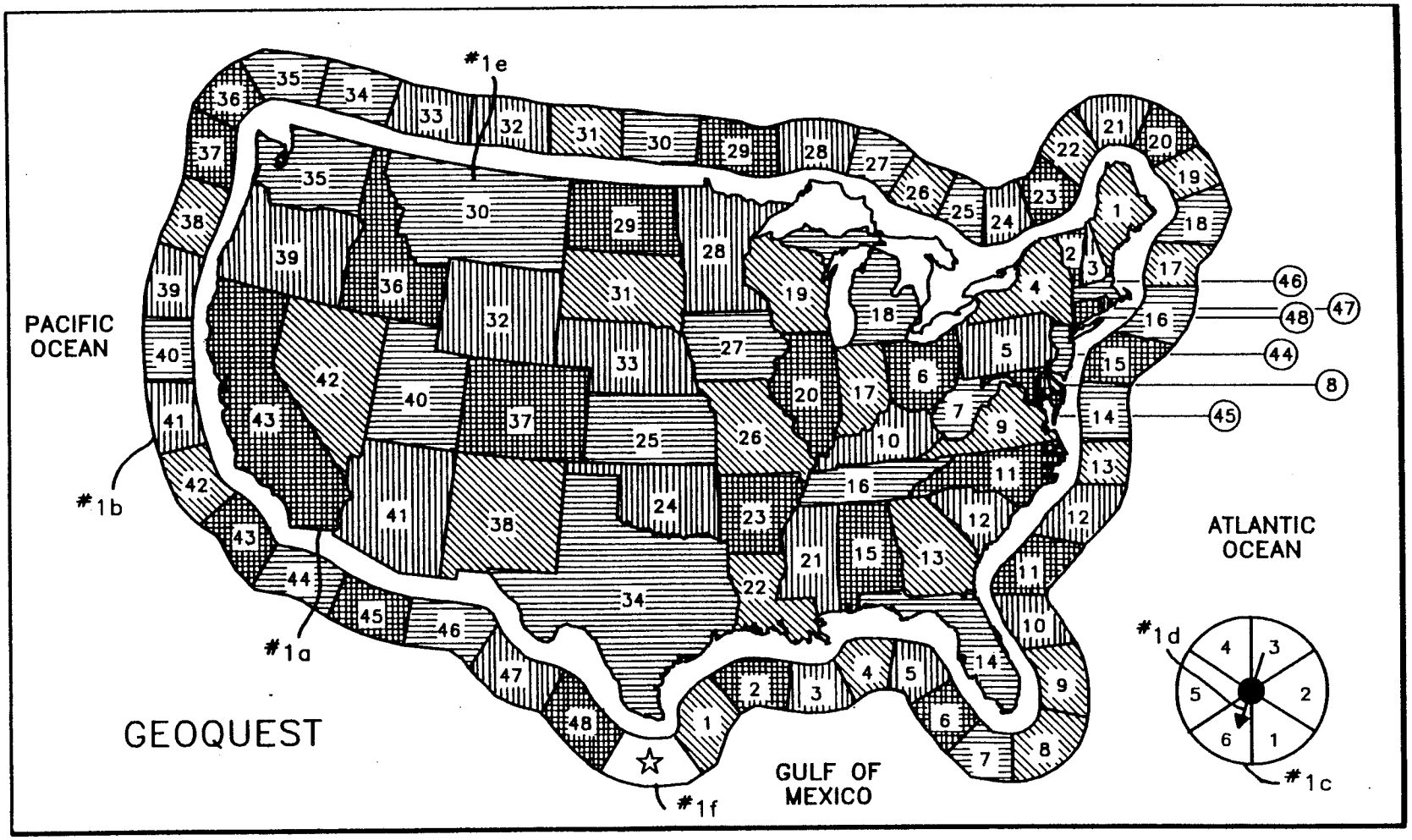
FIG. 1 is a plan view of one form of the board for the game dealing with the embodiment designated to the market under the name GeoQuest U.S.A. The structure of the composition of this board can be the same for other embodiments of the game.
Figure 3B:
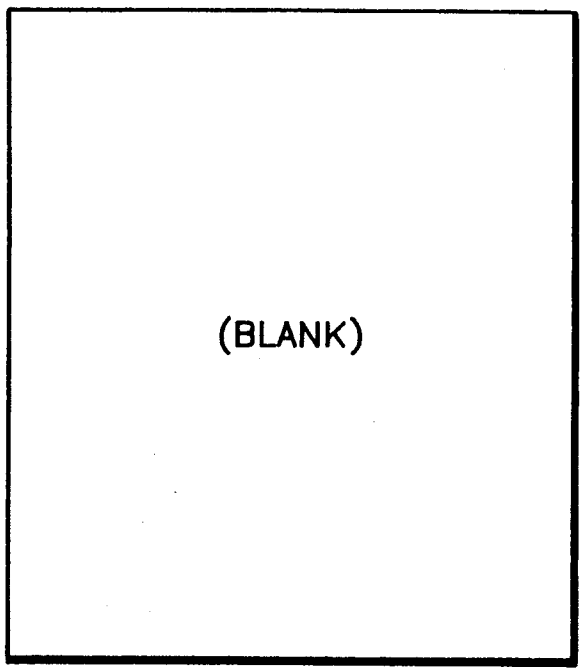
FIG. 3B is a front view of a game card.

Each particular property on the board (FIG. 1) is colored one of several separate and distinct colors. The properties are also numbered so that each one has a number different from that of any other property on the game board apparatus. The game card apparatus with the representation of that same particular property is colored and numbered the same as the manner in which the property is identified on the game board apparatus (FIG. 3*b*) On the reverse side of each card is the name of that property as well as the name of the capital city of that property. The geographic region or continent is surrounded by a numbered, multicolored trail (FIG. 1 #1*b*). The colors and numbers on the trail correspond directly to those on the map section of the board (FIG. 1 #1*a*) and game cards (FIG. 3*b*). The game board apparatus also bears a circle (FIG. 1#1*c*) divided into a number of equal triangular sections that are sequentially numbered. Attached to this circle at the center is a free moving pointer (FIG. 1 #1*d*).

Figure 2C:
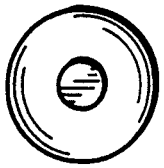
FIG. 2 is a side view of one of the tokens composing a set being moveable for travel during the course of playing the game.
Figure 2A:
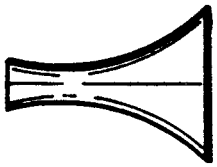
Figure 2B:
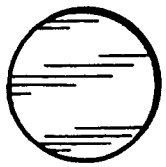
Figure 3A:
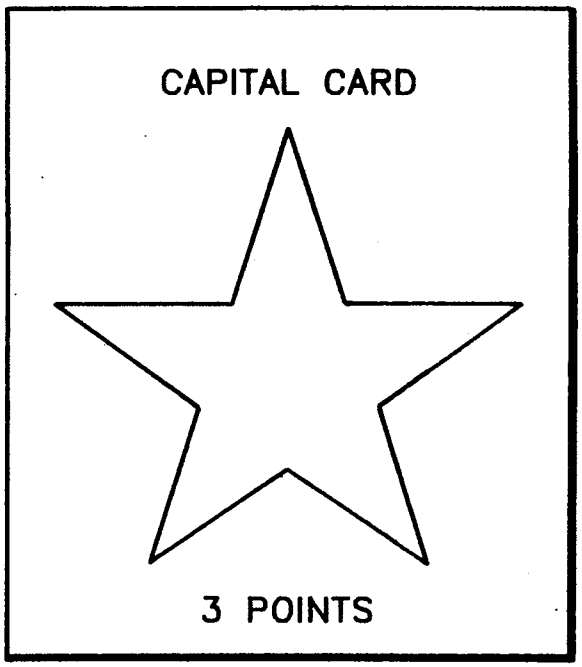
FIG. 3A is a front view of a capital card.
Figure 4B:
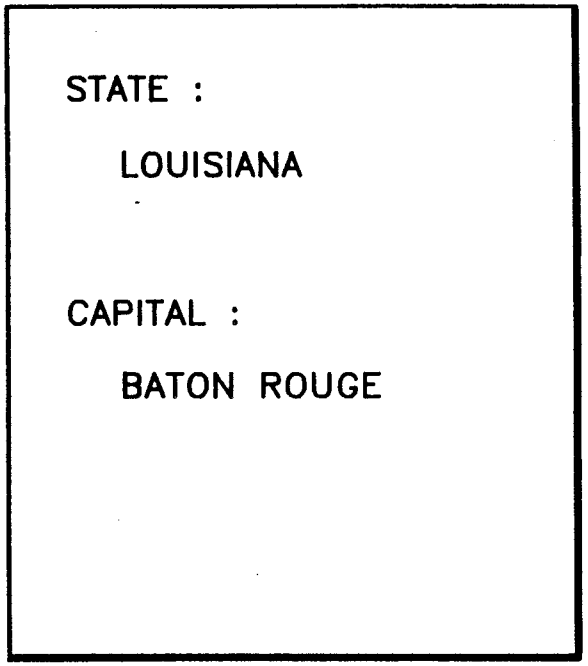
Figure 4A:
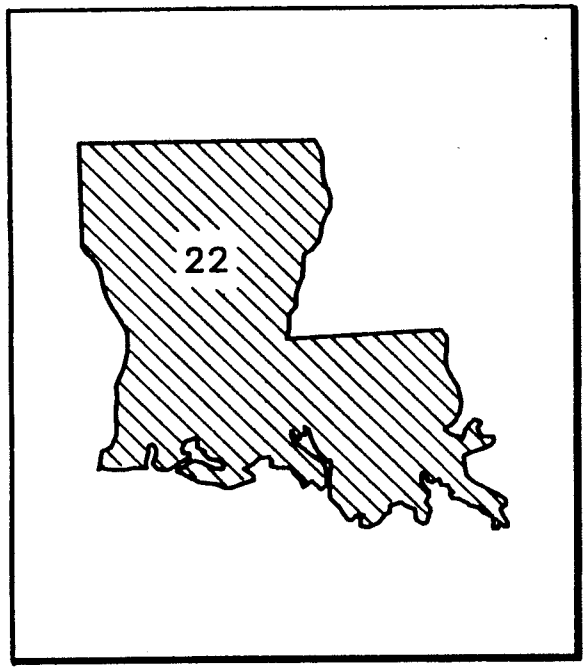
Figure 5B:
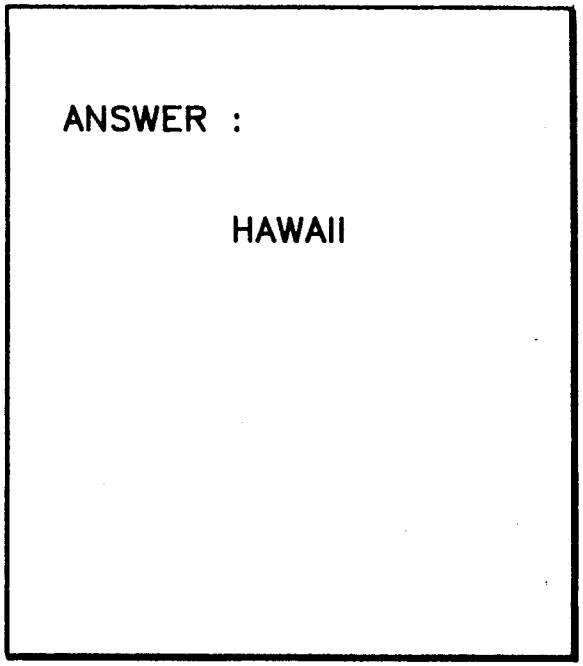
Figure 5A:
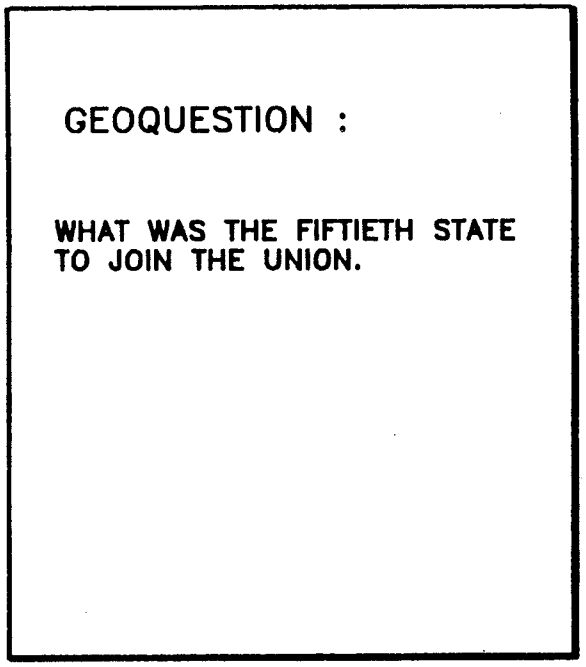

The object of the game is to identify the greatest number of particular properties (FIG. 1 #1*e*) within the geographic regions or continents depicted on the game board apparatus (FIG. 1) and thereby tally the highest total score. The apparatus included in the game are a plurality of game cards (FIG. 3), a plurality of tokens (FIG. 2), and a game board apparatus (FIG. 1). The player with the red token (FIG. 2) goes first. Play continues clockwise. Play begins on the space with the star (FIG. 1 #1*f*) and follows the numbers counter clockwise. The number of spaces to be moved is determined by a spin of the spinner (FIG. 1#1*d*). Attempt to name the particular property (FIG. 1#1*e*) and its capital that correspond in number and color to the space on the colored trail that you landed on. Check the back of the game card (FIG. 3*b*) that bears a matching likeness (FIG. 3*b*#31) to the particular property to verify your answer. You only reveal the back of the card to the other players if you have named both correctly. If you name both correctly, you may then select a GeoQuestion Card (FIG. 3*c*) and attempt to answer the questions presented thereon. Name the particular property incorrectly, and the player whose token (FIG. 2) is on the lowest number may try to name that particular property and its capital. They do not need to advance their token (FIG. 2). Name the capital incorrectly after correctly naming the particular property and the other players may try to name it during your turn beginning with the player to your right. If another player correctly identifies the capital during your turn, they get a capital card (FIG. 3*a*). A player may only try a GeoQuestion after he correctly identifies the particular property and its capital. If the particular property corresponding to the space on the trail (FIG. 1 #1*b*) has already been identified a player may move backwards (clockwise) to the first space their token encounters that has not been identified. There is a one minute time limit per player per turn. To total a players score at the end of the game to determine the winner one must know that a game card apparatus (FIG. 3*b*) is worth 2 (two) points, a game card apparatus (FIG. 3*a*) is worth 3 (three) points, and a correctly answered GeoQuestion (FIG. 3*c*) is worth 5 (five) points. There is no penalty for incorrect answers. Prior to the start of the game, the players should determine whether the game will end if a previously agreed upon time limit has expired, or if a previously agreed upon point total has been reached by one of the players, or if it will end when all of the particular properties have been identified.

It is understood that the above rules as well as the other components of the present disclosure dealing with the embodiments of the game, have been made only by the way of example and can be developed further on even radically changed. These modifications and variations however will not change the spirit and basic principles of the inventions explained herein above.

I therefore claim:

1. A board game apparatus of competition between players designed to enhance the geographic knowledge of the players, comprising:

a board acting as a playing surface having a map of a geographic region which is divided into a plurality of separate and distinctive properties, each of the properties is one of a plurality of colors and is assigned a separate number thereto;

said board including a trail forming a closed loop around the map, the trail being divided into individual spaces with each space corresponding to a separate property by being the identical color and identical number as its corresponding property wherein each number assigned to a particular property appears only once on the trail, the trail having one space designated as the players starting space and the numbers on the trail appear in increasing numerical order beginning adjacent to the starting space and proceeding around the trail in a counter-clockwise fashion;

a plurality of tokens constituting the playing pieces, each token representing a player's position on the trail of said board;

spinner means to determine the number of spaces to advance said token of the player along the trail during the player's turn;

a plurality of game cards having one specific game card for each colored and numbered space on the trail, the front face of said game card depicts the shape of the property and is colored and numbered the same as the property on the map on said board; the back face of said game card discloses the name of the property and its capital;

a plurality of capital cards wherein all the capital cards are identical to one another, each said capital card represents an award to a player earning said capital card; and a plurality of geoquestion cards containing a question of geographic nature on the front face and the answer on the back face of said geoquestion card; whereby a player is entitled to a geoquestion card only after correctly identifying the property and capital represented by the space on which the player's token has landed.

2. The board game apparatus of claim 1, wherein the map of a geographic region is a map of the continental United States of America and the properties correspond to individual states in the continental United States.

* * * * *